United States Patent [19]

Hars et al.

[11] Patent Number: 5,048,418

[45] Date of Patent: Sep. 17, 1991

[54] FLEXOGRAPHIC PRINTING MACHINE WITH A TEMPERATURE-REGULATED PRINTING-MACHINE FRAME

[75] Inventors: Christoph Hars; Ottomar Tessmann; Klaus Schirrich; Bodo Steinmeier, all of Bielefeld, Fed. Rep. of Germany

[73] Assignee: Fischer & Krecke, Bielfeld, Fed. Rep. of Germany

[21] Appl. No.: 946,618

[22] Filed: Dec. 29, 1986

Related U.S. Application Data

[63] Continuation of Ser. No. 692,146, Jan. 17, 1985, abandoned.

[30] Foreign Application Priority Data

Jan. 18, 1984 [DE] Fed. Rep. of Germany ..... 3401626

[51] Int. Cl.[5] ..... B41F 5/18; B41F 13/00

[52] U.S. Cl. ..... 101/178; 101/216

[58] Field of Search ..... 101/178, 179, 152, 153, 101/216, 219, 228, 416 R, 416 A, 212, 181, 247; 100/93 R, 93 P, 93 RP, 93 S, 99

[56] References Cited

U.S. PATENT DOCUMENTS

| | | | |
|---|---|---|---|
| 680,135 | 8/1901 | Drew et al. | 100/93 RP |
| 1,724,644 | 8/1929 | De Long | 101/416 A |
| 1,867,256 | 7/1932 | Egli | 101/416 A |
| 2,269,836 | 1/1942 | Weiss | 101/416 R |
| 2,447,887 | 8/1948 | Worthington | 101/216 |
| 2,599,346 | 6/1952 | Offen | 101/416 A |
| 2,849,951 | 9/1958 | Heinrich | 101/416 R X |
| 2,972,298 | 2/1961 | De Marchi | 101/211 |
| 2,989,917 | 6/1961 | Brodie | 101/211 |
| 3,064,563 | 11/1962 | Cook | 101/216 |
| 3,391,638 | 7/1968 | Ebneter | 101/178 |
| 3,704,669 | 12/1972 | Christoff | 100/93 RP |
| 3,888,173 | 6/1975 | Ritzerfeld | 101/350 |
| 4,006,633 | 2/1977 | Shipman et al. | 73/190 H |
| 4,527,473 | 7/1985 | Littleton | 101/226 X |

*Primary Examiner*—J. R. Fisher

*Attorney, Agent, or Firm*—Wegner, Cantor, Mueller & Player

[57] ABSTRACT

The flexographic printing machine with an impression cylinder mounted in a double-sided printing-machine frame and regulated to a constant operating temperature, and with several flexographic printing units, is characterized in that the printing-machine frame is temperature-stabilized at least in the projection range of the impression cylinder. It thereby becomes possible to guarantee a high printing quality, even without readjustment, after the operating temperature has been reached.

14 Claims, 7 Drawing Sheets

FLEXOGRAPHIC PRINTING MACHINE WITH A TEMPERATURE-REGULATED PRINTING-MACHINE FRAME

This application is a continuation of U.S. application Ser. No. 692,146 filed Jan. 17, 1985, now abandoned.

The major problem on which the invention is based is explained below with reference to so-called single-cylinder flexographic printing machines, because it arises to a significant extent on these during printing. However, the invention is not restricted to single-cylinder flexographic printing machines.

Single-cylinder flexographic printing machines have a large common impression cylinder, around which 4 or 6 flexographic printing units are arranged in the two embodiments in most widespread use today. Depending on the working width of the flexographic printing machine, the format range and the number of flexographic printing units arranged around the common impression cylinder, the impression cylinder has a diameter of 1 to 2 m and, in special cases, even more than 2 m.

The impression cylinders have to be produced with a very high true-running accuracy which must also continue to be guaranteed during the operating time. For example, according to present experience, the permissible concentricity error of the impression cylinder on a single-cylinder flexographic printing machine should not exceed a maximum value of ±5 microns (= +0.005 mm). This condition becomes absolutely stricter with an increase in diameter of the impression cylinder. Thus, in contrast to a single-cylinder flexographic printing machine, on so-called multi-cylinder flexographic printing machines, on which each individual printing unit has assigned to it a separate impression cylinder, the diameter of which can be set between 100 and 300 mm mainly as a function of the working width, instead a greater concentricity deviation is acceptable for the impression cylinder, since, because of the sharper curvature of the impression cylinder, the area of contact between the printing-block cylinder and the impression cylinder is narrower, the advancing force of the printing-block cylinder against the impression cylinder is consequently lower for a given thickness tolerance of the printing block and the print material, and the capacity for compensating the printing-blocks is more favorable.

On single-cylinder flexographic printing machines, to ensure that the exact concentricity of the impression cylinder can be maintained in any operating state, the impression cylinder is usually temperature-regulated in present-day single-cylinder flexographic printing machines and is consequently maintained at a predetermined temperature level.

A further aggravating factor, particularly on single-cylinder flexographic printing machines, is that so-called intermediate-drying means are arranged in a flexographic printing machine between the individual flexographic printing units, and especially when non-absorbent print materials are printed, these are of great importance and perform the function of at least surface-drying the ink applied in preceding printing units, before further ink is applied in the printing unit following next either over an area or in a pattern of dots.

The intermediate dryers usually operate on the principle of the so-called convection dryers in which a forced air stream is blown onto the freshly printed web of material and at the same time is sucked away again by means of the so-called intermediate-drying blowing-/suction box. To assist the drying operation, the temperature of the blown air is usually regulated, the temperatures amounting, primarily as a function of the print material, to, for example, between 40° and 60° for many plastic foils, but even up to 100° C. and above for the printing of paper.

Consequently, especially when a single-cylinder flexographic printing machine is at a standstill or even when it is running slowly, considerable thermal influences can be exerted by an intermediate dryer on the common impression cylinder, so that the latter, insofar as it is not maintained at a constant temperature level by other measures, would have to experience very uneven heating which could not be prevented from eventually influencing the true-running accuracy.

Steel impression cylinders with an outer double steel wall, its interspace providing a natural temperature-regulating water channel, are known. Temperature-regulating water is conveyed through this temperature-regulating water channel virtually without pressure and by means of water-conveying elements and is maintained at a predetermined temperature level by means of a temperature-regulating unit connected on the outside. Single-walled, mainly cast-iron impression cylinders are also known, and in these the temperature-regulating water is sprayed against the cast-iron cylinder shell from inside. A disadvantage of this spray technique necessarily carried out on single-shell impression cylinders can be that there forms at the bottom, inside the cylinder, a water sump which, when the impression cylinder rotates, leads to uncontrolled sloshing movements of the sump water and consequently to irregular rotation of the impression cylinder, and this can have an adverse effect on the stability of the machine register.

When the temperature of the impression cylinder is regulated exactly, its dimensions remain practically constant irrespective of the operating state of the printing machine; in any case, when the temperature-regulating system is working properly, it is not possible to detect any dimensional displacements relevant to the printing operation.

Flexographic printing, which has advanced greatly in recent years and which is now carried out with high printing qualities, from time to time experiences the following incidents presenting problems, when single-cylinder flexographic printing machines are used: a short time after starting, mainly the starting of a single-cylinder flexographic printing machine, for example after an operating time of 5 to 10 minutes, errors which are first slight and are hardly noticeable, but which then become more evident occur in the printing, and these make it necessary to readjust the printing units immediately. However, this fault can be rectified only after it has occurred to a visible degree. But it is then no longer possible to prevent defective print patterns from being contained within a printed roll of material, and under certain circumstances these can even lead to the rejection of the entire roll of material, because it is subsequently no longer possible, during the further processing of a printed roll, to single out the incorrectly printed products which are possibly present in only small numbers.

This phenomenon, when it occurs, is attributed to an insufficient feed setting of the printing units the feed-setting members of which have moved or shifted slightly as a result of the vibrations and impact forces occurring during printing. The fault is then rectified by means of slight readjustment of the printing units.

The phenomenon usually does not arise at all when a somewhat firmer feed setting of the printing units has been carried out from the start of printing, so that the presumed shifting and retraction of the printing units have not led to printing errors. A closer analysis and more detailed investigations resulting from this show that the phenomena which are noticeable from time to time have a different cause from that previously presumed.

Consequently, the object on which the invention described below is based is, for flexographic printing machines, especially single-cylinder flexographic printing machines, to find a solution to the problems arising from the phenomena described, and to avoid the cause of printing failures occurring occasionally a short time after the start of operation.

The invention starts from the knowledge that temperature-dependent material expansions in the two side frames of the printing machine are responsible as the cause of the printing failure which first appears only gradually. Whereas, as described in detail above, the impression cylinder of single-cylinder flexographic printing machines is maintained at a constant temperature level by means of a separate temperature-regulating system, in order to compensate the influence distributed unevenly over the periphery of the impression cylinder and exerted by the hot air of the intermediate drying means, and to guarantee high true-running accuracy, the need for uniform temperature regulation, demanded especially for high-quality flexographic printing, has hitherto not been recognised as also being required for the printing-machine frame carrying the printing units.

The state of expansion of the printing-machine frame can vary to an extent relevant to the printing operation, particularly as a result of thermal radiation from the inflow and flow-off pipes for intermediate drying, but also as a result of a variation in the room temperature, possible, on the one hand, for example because of cold draught air and, on the other hand, because of thermal radiation in the machine itself, for example from the main motor of the bridge drying system, the roll drives, etc., or even because of adjacent machines. If heating of the printing-machine frame occurs when the impression cylinder is at a constant temperature, the frame expands slightly and the printing units move away from the impression cylinder, and in the case of an appropriately fine presetting of the printing units this can lead to the printing errors described. When the printing-machine frame cools, the printing units move towards the impression cylinder, but because of the comparatively slight feed movement this has scarcely any effect on the printing result or an effect only in extreme situations.

On a single-cylinder flexographic printing machine with an impression cylinder having a diameter of approximately 2 m, a variation in frame temperature of around 1° Kelvin has the effect of a relative displacement of the printing units of approximately 0.01 mm.

The solution according to the invention involves stabilizing the temperature of the printing-machine frames in a similar way to the impression cylinder, and for this purpose the printing-machine frames are equipped, for example, with internally guided water channels, through which temperature-regulating water is conveyed, consequently maintaining the printing-machine frame at a constant temperature.

The outlay involved in casting channels of this type into the cast-iron framework of a printing machine is comparatively low. A further possibibity is to glue or screw to the printing-machine frame so-called temperature-regulating coils, that is to say a pipeline conveying a temperature-regulating fluid and having good thermal conduction, particular importance being attributed to a high heat transmission coefficient between the temperature-regulating coil system and the printing-machine frames.

According to the invention, such temperature stabilization of the printing-machine frames is necessary at least in the projection range of the impression cylinder, since it can be assumed with sufficient accuracy that the side parts of the printing units including the brackets, on the one hand, and the main printing stand in the projection range of the impression cylinder, on the other hand, are heated uniformly. Outside the periphery of the impression cylinder, the thermal expansions cancel one another, identical heating being assumed. However, within the periphery of the impression cylinder, a relative expansion difference occurs, on the one hand because the temperature of the impression cylinder is fixed, and on the other hand because of the hitherto neglected temperature stabilization of the printing-machine frame.

It can also be expedient to ensure, by means of a limited temperature-regulating range, that heat is prevented from being introduced into the printing-machine frames. Heat radiation into the printing-machine frames can occur, for example, in the perforations for the air conveying pipes of the intermediate drying system. Heat is effectively prevented from being introduced here locally by means of a temperature-regulating channel extending all around the perforations. Such an annular channel can also be formed by a temperature-regulating coil having a good heat transmission coefficient and extending all around the perforations for the intermediate-drying air-conveying pipes.

Another possibility for achieving the solution of controlled temperature regulation or temperature stabilization is to provide the printing-machine frames with air guide and temperature-regulating ribs at least on one side, so that temperature regulation of the printing machine frames is achieved by means of an air stream of regulated temperature. A better, but technically more expensive solution is obtained by means of a double-walled frame which acquires sufficiently high stability because of vertical intermediate walls or ribs and which at the same time guarantees the most efficient possible guidance for an internal air-temperature regulating system.

Systems for temperature stabilization are especially necessary on manually actuated printing machines. On flexographic printing machines of the latest state of the art, in which the original manual-adjustment members are replaced by CNC-controlled electromotive drives, there is no longer any obstacle to achieving automatic compensation of different states of thermal expansion as a result of varying temperature regulation via the CNC control by means of constant temperature measurement of the printing stand and also the average temperature of the temperature-regulating water for the impression cylinder. Temperature sensors located on the printing machine frames detect temperature changes for the adjustment of printing units controlled by motors.

The invention and advantageous details are explained in more detail below in exemplary embodiments with reference to the drawings. In the drawings.

Figure 1:
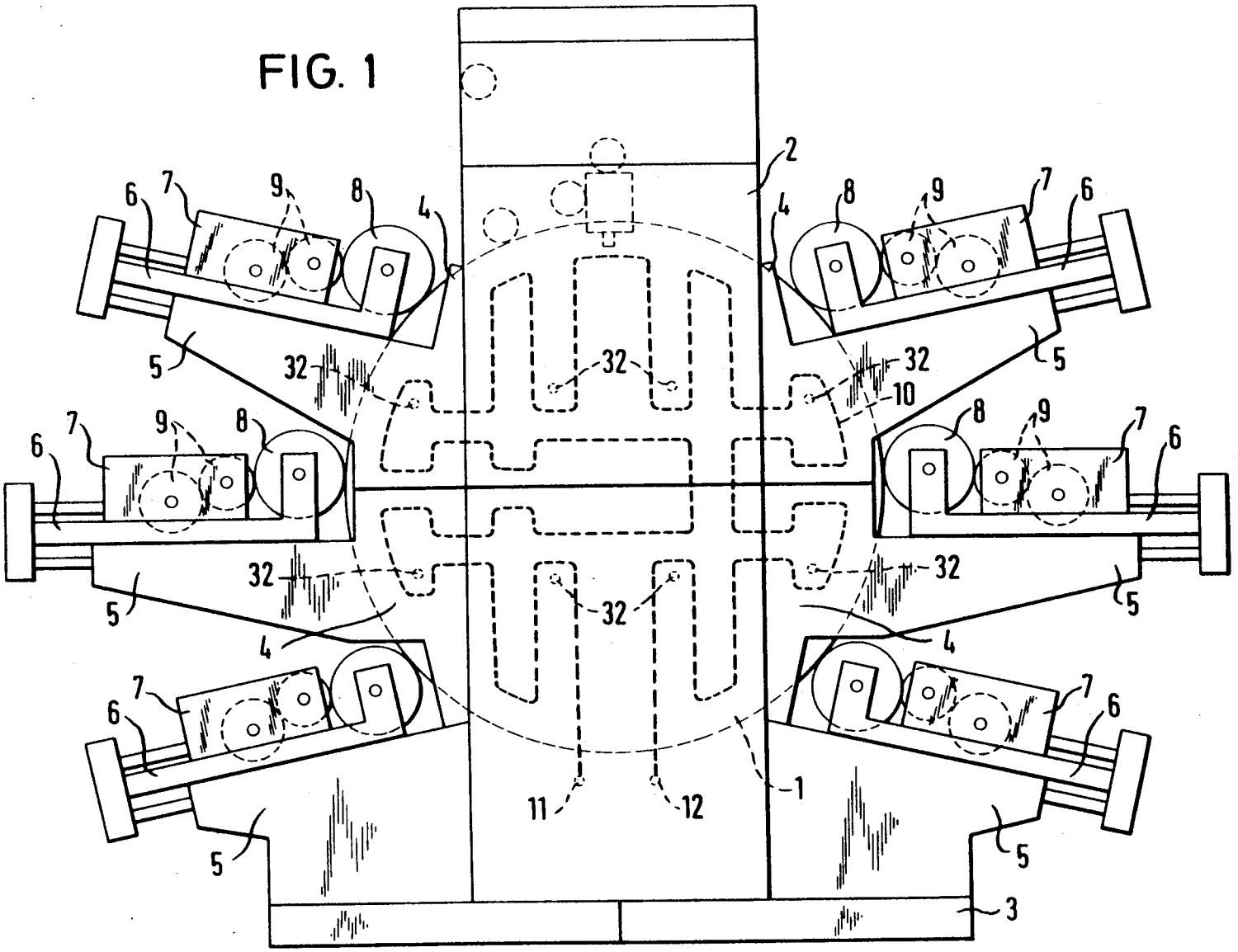
FIG. 1 shows, in a diagrammatic representation, a side view of a single-cylinder flexographic printing stand with six printing units.

In FIG. 1, the impression cylinder 1 of a single-cylinder flexographic printing stand with six printing units is shown in outline. The printing stand consists, in detail, of the main frame 2 which is usually multi-part and is attached to the baseplate 3 and which receives, in addition to the mounting for the impression cylinder 1, usually multi-part frames 4, in the example shown here for four printing units these frames merging continuously into the printing-unit brackets 5. The printing units consist, in detail, of the printing-unit trestle 6 and the inking-unit trestle 7 and each serve for receiving a plate printing cylinder 8 and, for example, a pair of inking rollers 9. As described, but not shown in any more detail in the drawing, the impression cylinder 1 is equipped with a temperature-regulating water conveying system, so that the impression cylinder 1 is maintained at a constant temperature level with a high degree of accuracy. According to the invention, the main printing stand consisting of the side parts 2 and 4 is likewise maintained at a constant temperature level in the projection range of the impression cylinder 1. To achieve this, the printing stand 2, 4 is equipped, in the projection range of the impression cylinder, with a continuous temperature-regulating channel, so that only one temperature-regulating water inflow 11 and one temperature-regulating water outflow 12 is required. The advantage of this, in comparison to a multi-part temperature-regulating system to be subjected to a flow medium in parallel, is that it is guaranteed that the temperature-regulating medium will flow through at an equal rate in all regions.

Figure 2:
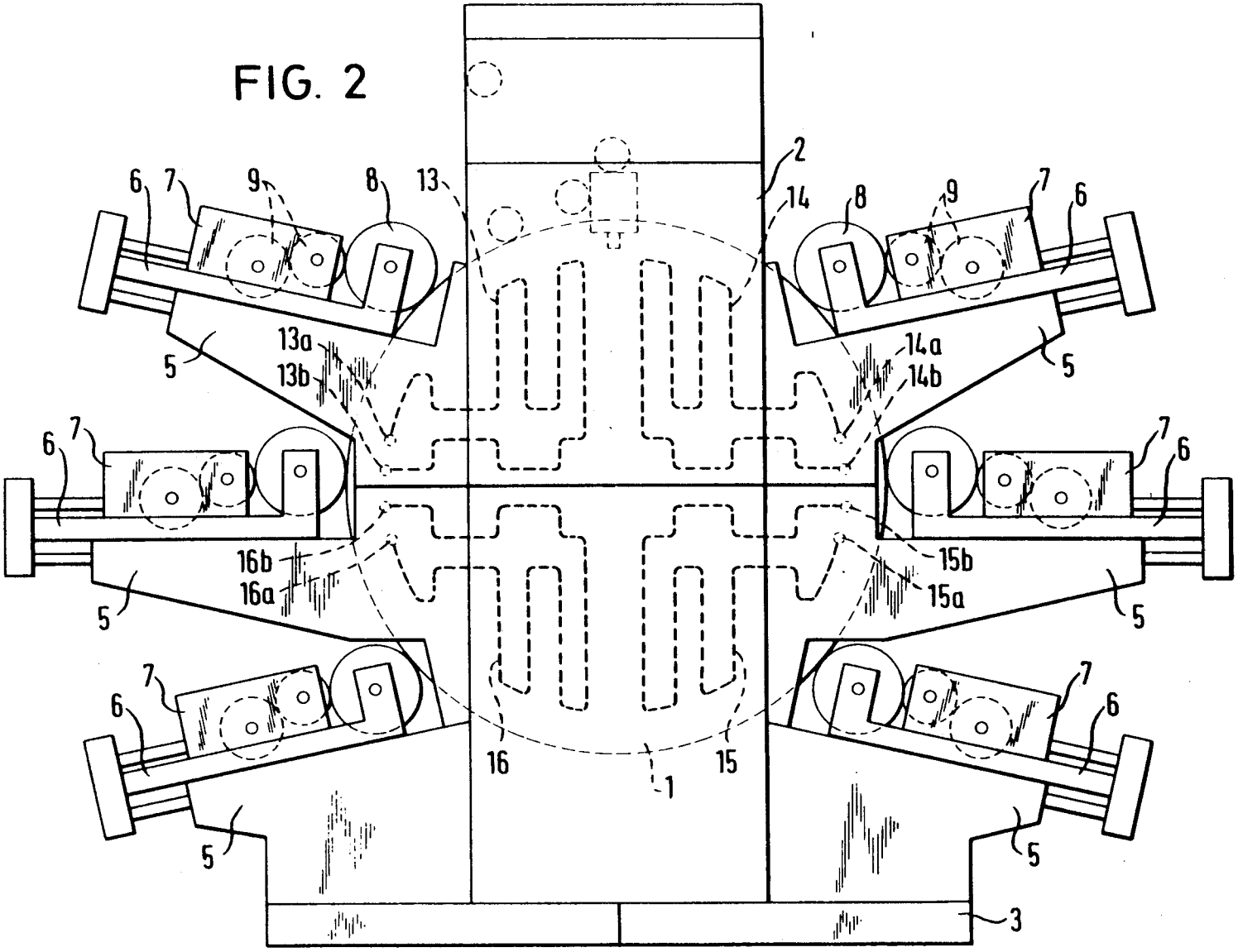
FIG. 2 shows a side view of a differently designed embodiment of a single-cylinder printing stand, again with six printing units.

FIG. 2 shows a side view of a single-cylinder flexographic printing stand with six printing units similar to that of FIG. 1, but with four separate temperature-regulating channels 13, 14, 15 and 16 having the inflow and outflow connections 13*a,b*, 14*a,b*, 15*a,b* and 16*a,b*. The advantage of a channel system according to FIG. 2 in comparison with the channel system according to FIG. 1 is that both a series connection according to FIG. 1 and a parallel connection are possible for the flow through the four temperature-regulating regions, depending on how the connections 13*a,b*, 14*a,b*, 15*a,b* and 16*a,b* are subjected to the flow medium. In the latter case, it is merely necessary to ensure, by means of a measure in the temperature-regulating medium supply region, that the same quantity of temperature-regulating medium flows through all four temperature-regulating channels 13, 14, 15 and 16. In comparison with a series connection according to FIG. 1, the advantage of a parallel connection, which becomes possible according to FIG. 2, is that the temperature differences within the printing stand can be kept smaller.

Figure 3:
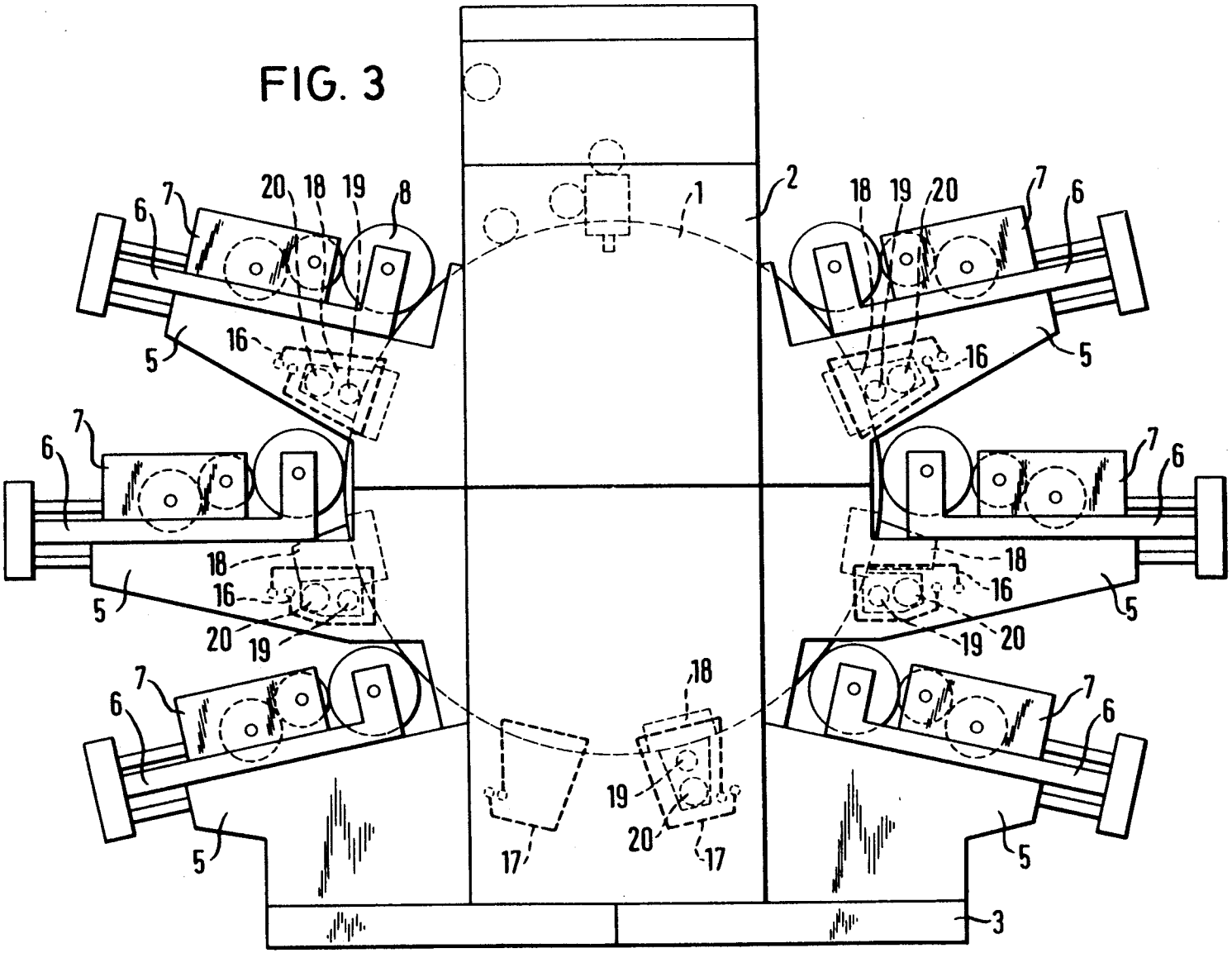
FIG. 3 shows the printing stand according to FIGS. 1 and 2, but in which only the temperature-regulating channels serving for protection against thermal radiation are shown.

FIG. 3 shows a printing stand according to FIGS. 1 and 2, but in contrast to the preceding Figures this only shows the temperature-regulating channels 16 and 17 which serve for protection against the thermal radiation emitted by the incoming-air and outgoing-air pipes for the intermediate drying means. The blowing/suction nozzles of the intermediate drying system are designated by 18, and the incoming-air and outgoing-air pipes for the intermediate drying system, which are guided through the printing-unit frame, are designated by 19 and 20 respectively.

A temperature-stabilized printing-machine frame will preferably possess both the temperature-regulating channel system according to FIG. 1 or 2 and the temperature-regulating channels according to FIG. 3.

The impression cylinder 1 is mounted on both sides. Consequently, a printing machine has side parts 2, 4 on both sides of the impression cylinder. The air-conveying pipes 19, 20 for the intermediate drying means 18 are usually supplied from one side only, so that the temperature-regulating channels 16 and 17 according to FIG. 3 only need to be subjected to temperature-regulating medium on the machine side on which the air-conveying pipes are located.

Figure 4:
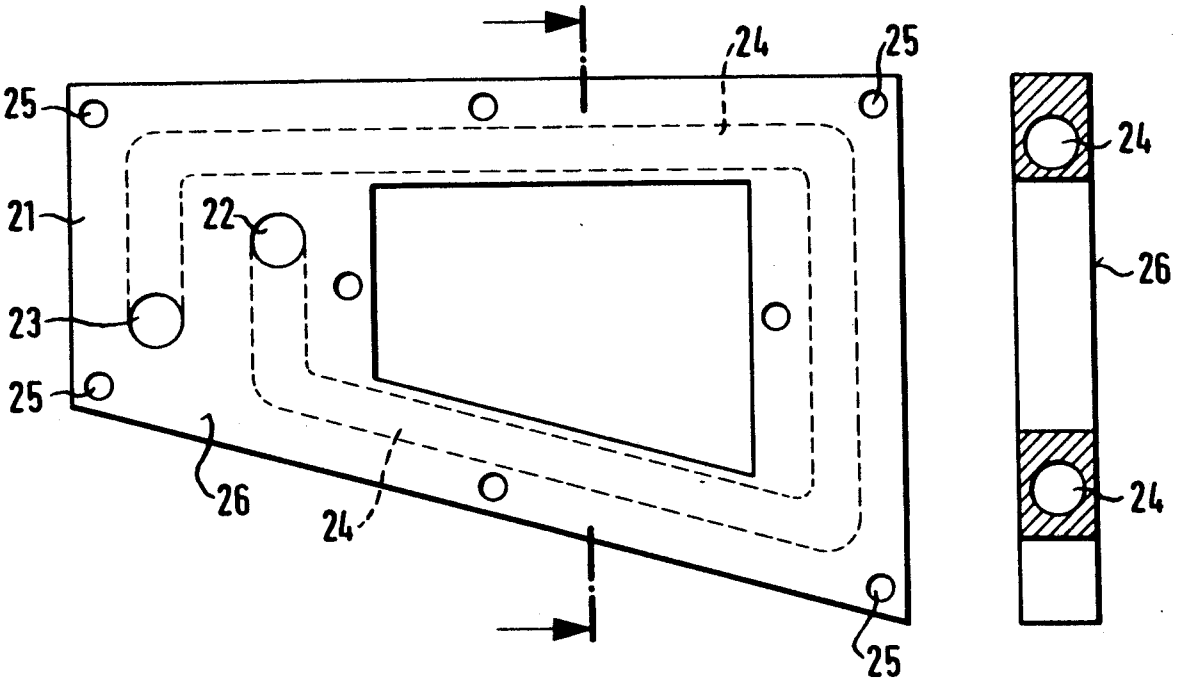
FIG. 4 shows a temperature-regulating coil with a cast-in temperature-regulating channel.

For reasons of space, the temperature-regulating channels 16, 17 according to FIG. 3 cannot be accommodated in every type of machine. In such a case, it is advantageous to screw a temperature-regulating coil 21, preferably cast from aluminium, from inside, towards the perforation, against the respective bracket 5 or, as regards the temperature-regulating coil 17, from inside against the frame 2. The temperature-regulating coil 21 (see FIG. 4) has a cast-in temperature-regulating channel 24 with the feed bore 22 and discharge bore 23. This temperature-regulating coil 21 precision machined on the underside 26 can be attached by screwing via the screwhole 25.

Figure 5:
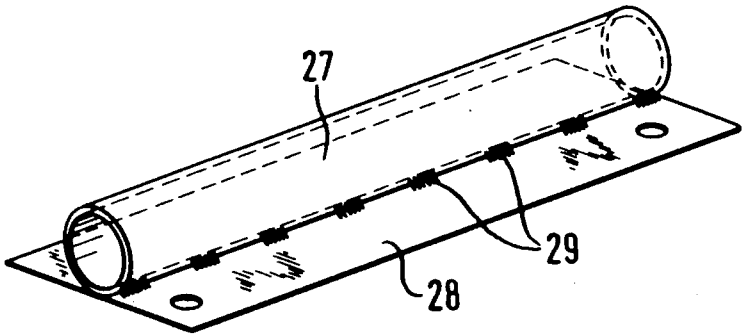
FIG. 5 shows a perspective view of a portion cut out from a larger temperature-regulating coil.

FIG. 5 shows, in a perspective view, a simplified cut-out from a larger temperature-regulating coil consisting essentially of the line pipe 27 for the temperature-regulating medium and of a screw-on plate 28 welded to the pipe 27 by means of the weld seam 29. Large-surface meander-shaped temperature-regulating coils according to FIG. 5 can be screwed to the printing-machine frame or frames on the smooth non-ribbed side of the printing stand 2,4 as an alternative to the cast-in temperature-regulating channels according to FIGS. 1 and 2, but at the same time it is necessary to ensure very good heat transmission from the screw-on plate 28 to the frame 2 or 4.

Since an attached temperature-regulating coil can in any case cause less heat dissipation than a cast-will in temperature-regulating system according to FIGS. 1 and 2, a printing stand with a screwed-on temperature-regulating system must preferably be protected against the unimpeded penetration of heat from outside as a result of further covering, primarily towards the ribbed side, by means of a cover plate.

Figure 6:
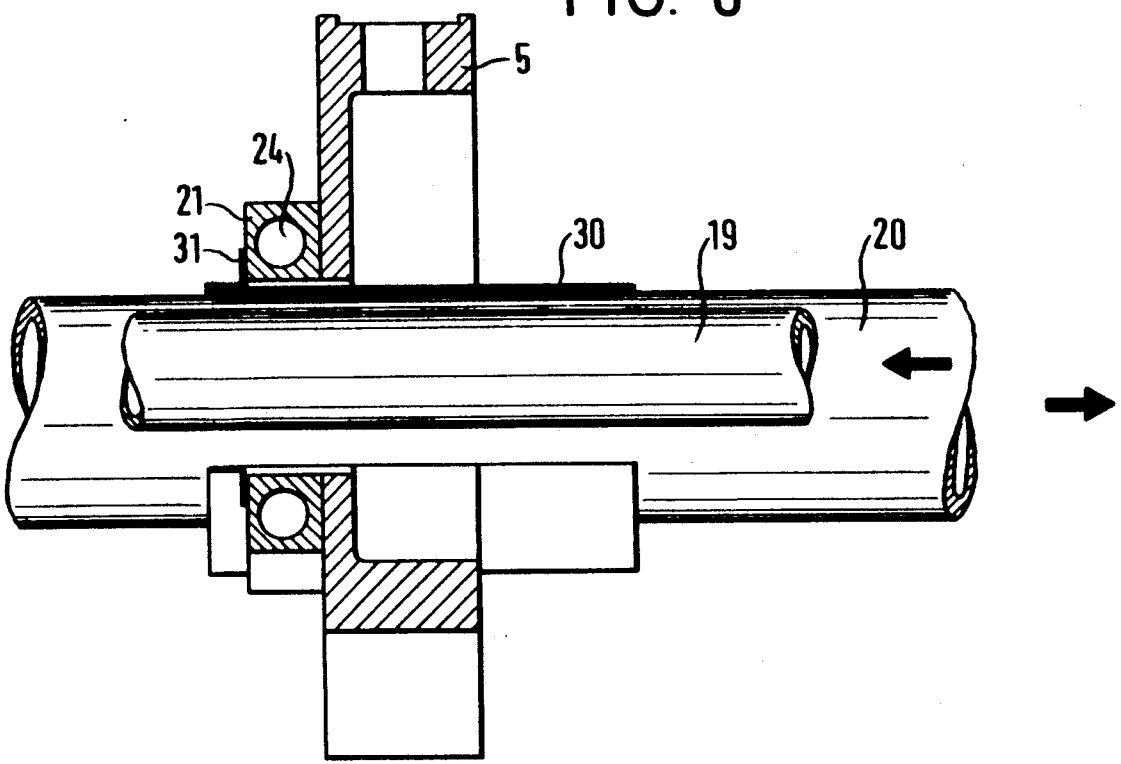
FIG. 6 shows a section through a bracket in the region of a temperature-regulating coil.

A similar cover plate according to FIG. 6 serves to prevent unimpeded thermal radiation from the incoming-air and outgoing-air pipes for the intermediate drying system to the printing-unit brackets and consequently make it easier to ensure temperature regulation by means of the temperature-regulating coil attached from inside. FIG. 6 gives a diagrammatic representation. It shows a section through the bracket 5, the temperature-regulating coil 21 with the cast-in channel 24 for conveying the temperature-regulating medium, the air supply and discharge pipe 18 and 19 and the cut-open screen 30 which is screwed to the temperature-regulating coil 21 or the bracket 5 with low thermal conduction, the retaining straps 31 preferably being made of plastic and the screen 30 being inserted at a short distance from the attached temperature-regulating coil 24 and bracket 25.

Finally, FIG. 1 also indicates temperature-measuring points 32, at which the current temperature of a printing-machine frame can be constantly measured and monitored, and this can be used to give a reading, but, particularly on numerically controlled printing units, can also be used on a software basis for automatic readjustment of the printing units.

Figure 7:
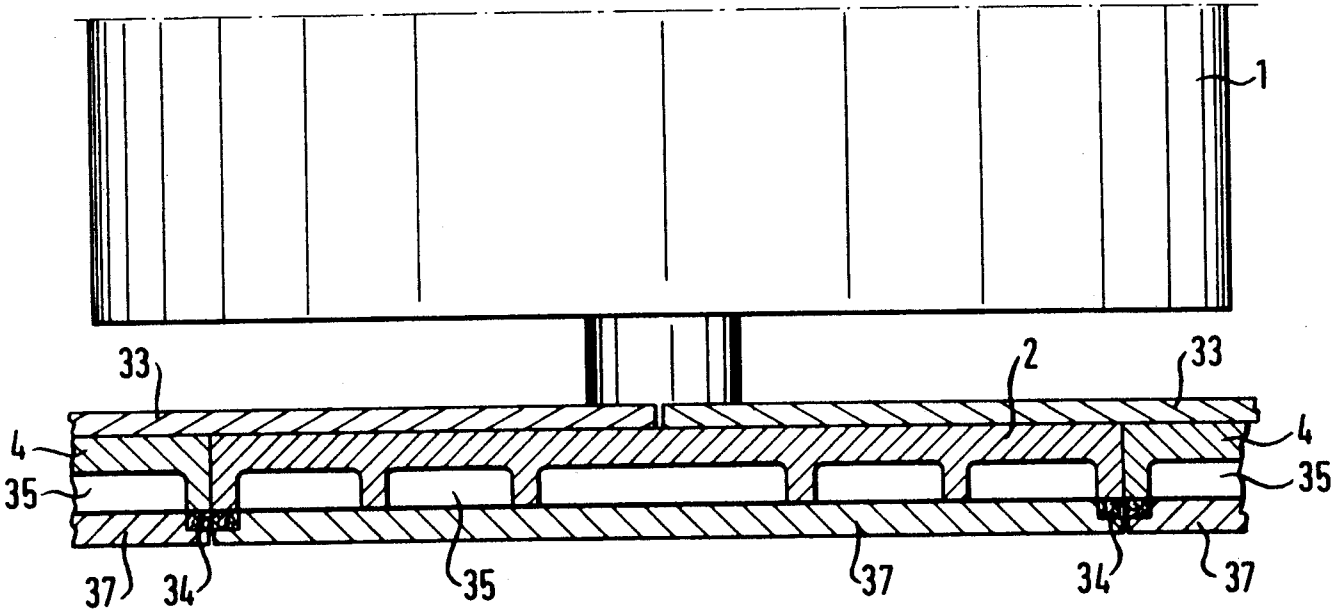
FIG. 7 shows a plan view in horizontal section of a portion cut out from a printing-machine frame having features according to the invention.

Instead of a temperature-regulating liquid which, for example, flows through the temperature-regulating channel 10 according to FIG. 1, the temperature of the printing-machine frame can also be regulated by means of an air stream if the ribs of the printing stand are of appropriate design and if there is a heat-insulating cover plate on the outside. In this case, however, it is necessary to ensure that the conveyance of air in the printing-machine frame does not cause any air movement in the outer region of the printing stand, since this could have an adverse effect on the printing process. FIG. 7 shows, in a horizontal section, a plan view of the sectional printing-machine frame 2, the impression cylinder 1, an outer cover plate 32 and an inner two-part screen plate 33. The temperature-regulating air flows in a vertical direction through the space 35 ribbed from the side part 2. To prevent an undesirable outflow of air between the side part 2 and cover plate 32, and on the other hand to keep away from the cover plate 32 machine vibrations which unavoidably occur in machine stand 2, the cover plate 32 is screwed to the side part 2 via felt gaskets 34.

What is claimed is:

1. A flexographic printing machine comprising:

an impression cylinder regulated at a constant operating temperature;

at least one flexographic printing unit positioned about the periphery of the impression cylinder;

a double-sided printing machine frame onto which said impression cylinder is mounted comprising at least one printing unit bracket on which said printing unit is mounted; and means for regulating said frame at a constant temperature to prevent expansion and contraction of the frame during operation of the printing machine to maintain said impression cylinder and said printing unit at constant relative positions.

2. A flexographic printing machine in accordance with claim 1, wherein said frame is of a one-piece construction.

3. A flexographic printing machine in accordance with claim 1, wherein said frame is of a multi-piece construction.

4. A flexographic printing machine in accordance with claim 1, wherein the printing machine frame is provided with closed guide channels for passage of a temperature regulating fluid.

5. A flexographic printing machine in accordance with claim 4, wherein the printing machine frame is comprised of cast iron having temperature regulating fluid guide channels incorporated therein.

6. A flexographic printing machine in accordance with claim 4, wherein the printing machine frame is provided with temperature regulating lines through which a liquid temperature regulating fluid flows.

7. A flexographic printing machine in accordance with claim 6, wherein said temperature regulating lines are screwed onto said frame.

8. A flexographic printing machine in accordance with claim 6, wherein said temperature regulating lines are glued onto said frame.

9. A flexographic printing machine in accordance with claim 1, wherein at least one side of the double-sided printing machine frame is provided with ribs for the controlled guidance of a temperature regulating air stream.

10. A flexographic printing machine in accordance with claim 9, wherein ribs forming air guide channels for an internal air temperature regulating system are provided between the walls of the double-walled frame.

11. A flexographic printing machine in accordance with claim 1, further comprising devices for intermediate drying positioned about the periphery of the impression cylinder between the flexographic printing units, said devices being supplied with hot air delivered through pipelines, wherein the printing machine frame is provided with local temperature regulating devices to prevent uneven heating of the frame adjacent to said devices for intermediate drying.

12. A flexographic printing machine comprising:

an impression cylinder regulated at a constant operating temperature;

at least one flexographic printing unit positioned about the periphery of the impression cylinder;

a double-sided printing machine frame onto which said impression cylinder is mounted comprising at least one printing unit bracket on which said printing unit is mounted; and means for regulating said frame, with the exception of the printing unit bracket, at a constant temperature to prevent expansion and contraction of the frame during operation of the printing machine to maintain said impression cylinder and said printing unit at constant relative positions.

13. A flexographic printing machine comprising:

an impression cylinder regulated at a constant operating temperature;

at least one flexographic printing unit positioned about the periphery of the impression cylinder;

a double-sided printing machine frame onto which said impression cylinder is mounted comprising at least one printing unit bracket on which said printing unit is mounted; and a compensating means for reading the temperature of the frame and adjusting the printing unit based on changes in said reading so as to maintain said printing unit and said impression cylinder at constant relative positions, wherein said compensating means comprises a computer-numerical-controlled device that detects readings from temperature sensors located on said frame and transmits temperature dependent connecting signals to an electromotive drive connected to said printing unit.

14. A flexographic printing machine according to claim 13, further comprising means for regulating said frame at a constant temperature to prevent expansion and contraction of the frame during operation of the printing machine to maintain said impression cylinder and said printing unit at constant relative positions.

* * * * *